United States Patent [19]

Bizzarri

[11] Patent Number: 4,720,697

[45] Date of Patent: Jan. 19, 1988

[54] TERMINAL FOR ELECTRICAL RESISTANCE HEATING ELEMENT AND A METHOD FOR THE MANUFACTURE OF SUCH TERMINALS

[75] Inventor: Venonzio Bizzarri, Hallstahammar, Sweden

[73] Assignee: Kanthal AB, Hallstahammar, Sweden

[21] Appl. No.: 796,184

[22] Filed: Nov. 7, 1985

[30] Foreign Application Priority Data

Nov. 7, 1984 [SE] Sweden ..... 8405577

[51] Int. Cl.[4] ..... H01C 1/144

[52] U.S. Cl. ..... 338/329; 338/332

[58] Field of Search ..... 338/329, 332, 238, ; 219/553, 541; 174/84 C, 90, 77 R; 339/276 T, 223 R

[56] References Cited

U.S. PATENT DOCUMENTS 2,003,175 5/1935 Daly ..... 174/77 R 3,955,044 5/1976 Hoffman et al. ..... 174/90 X 4,021,770 5/1977 Bizzarri ..... 338/332

*Primary Examiner*—Clifford C. Shaw

*Assistant Examiner*—M. M. Lateef

*Attorney, Agent, or Firm*—Hill, Van Santen, Steadman & Simpson

[57] ABSTRACT

A terminal for electrical resistance heating elements, comprising a thin, resistance thread of a highly temperature resistant material, particularly $MoSi_2$, which at least one end thereof has a lead-in electrode of a material having a better conductivity than that of the resistance heating element and having a greater cross-sectional area than that of the resistance thread.

The terminal comprises an outer thin-walled sheating of stainless steel, one end of which is shaped as a sleeve and the other end of which is flattened into a flat connecting tongue having a transverse bore. The sheating contains a filling of aluminum wherein one end of the resistance thread is molten in.

3 Claims, 5 Drawing Figures

TERMINAL FOR ELECTRICAL RESISTANCE HEATING ELEMENT AND A METHOD FOR THE MANUFACTURE OF SUCH TERMINALS

BACKGROUND OF THE INVENTION

1. Field of the Invention

The present invention relates to a terminal for electrical resistance heating elements, particularly resistance heating elements having a glow-zone portion of a highly temperature resistant material. Further, the invention relates to a method for the manufacture of such terminals.

2. Prior Art

An electrical heating resistance element with terminals has been proposed, wherein the resistance element comprises a thin thread of a highly temperature resistant material, preferably essentially comprising molybdenum disilicide, $MoSi_2$, which thread has, at least at one end thereof, a terminal of a material of better conductivity than that of the heating resistance element material, preferably a thread-shaped terminal of aluminum, and having a cross sectional area which is considerably greater than that of the resistance thread. A characterizing feature of this previously proposed resistance element is that the end portion of the resistance thread is molten into the end portion of the terminal.

Resistance elements of the just described kind have been found to operate satisfactorily in many cases but they have also certain limitations and drawbacks. Thus, it may sometimes be somewhat elaborate to melt in the end portions of the resistance element into the end portion of the terminals, which normally consist of an aluminum thread. Further, a terminal in the shape of an aluminum thread has certain limitations with respect to the connection of the thread itself to a conducting element such as a pole screw or the like.

SUMMARY OF THE INVENTION

The present invention aims at providing a terminal which does not exhibit the just mentioned drawbacks and which has certain pronounced advantages as compared to the previously proposed terminals for elements of the just mentioned kind.

According to the present invention, the terminal is constructed with a tubular sheath enclosing the material having the physical properties of alumina, the sheath having a flattened apertured end portion for being connected to a complemental terminal, the opposite end portion serving as a container for the temporarily molten material.

An other object of the present invention is to provide a method for the manufacture of terminals of the just mentioned kind.

ON THE DRAWINGS

AS SHOWN IN THE DRAWINGS

Figure 1:
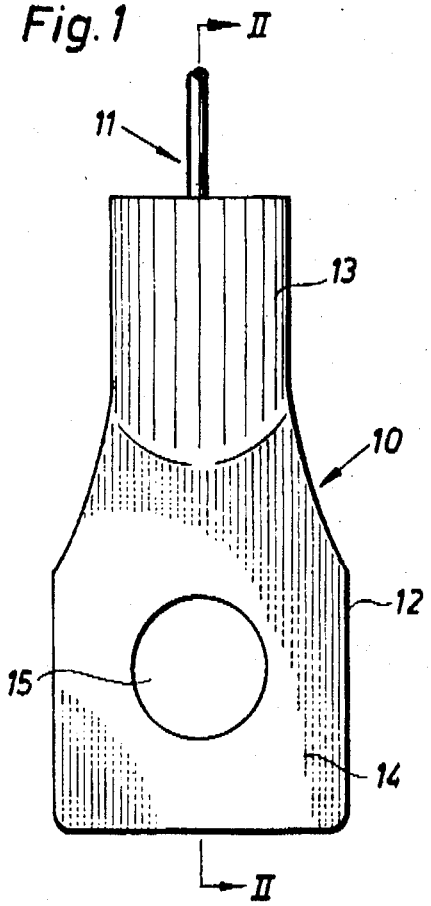
FIG. 1 is a plan view of one embodiment of the terminal according to the present invention, picked as an example only, arranged at the end of a thin resistance thread or filament of a highly temperature-resistant material.
Figure 2:
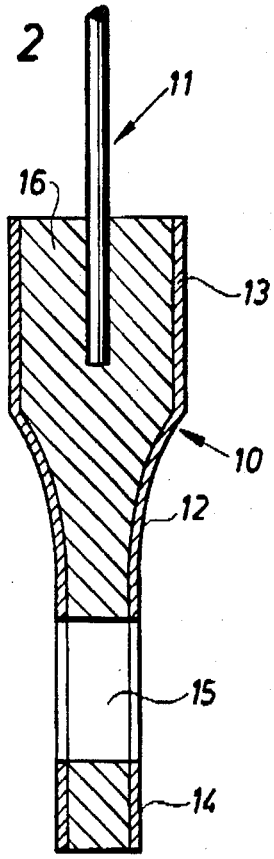
FIG. 2 illustrates the terminal of FIG. 1 in axial longitudinal section taken in the plane II—II of FIG. 1.
Figure 5:
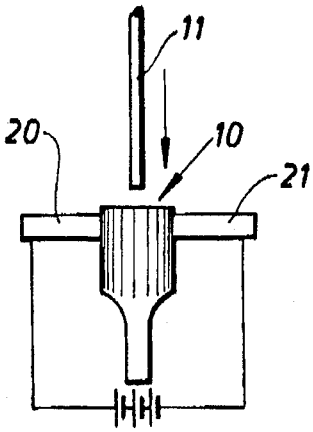
FIG. 5 illustrates schematically a melting step for melting in the end of the resistance thread into the terminal.

The terminal, generally denoted 10 in FIGS. 1, 2 and 5, is adapted for the connection of an end of a resistance element 11 to a current conducting member, not shown. The invention has been created in connection with electrical heating resistance elements of the kind which are composed of a thin thread of a highly temperature resistant material, preferably essentially comprising molybdenum disilicide, $MoSi_2$, and the invention is disclosed below essentially with reference to such elements although it is by no means restricted to be used only for such materials.

The terminal 10 comprises an outer, comparatively thin-walled sheath or jacket 12 of an electrically good conducting material, which may be formed by pressing, but which is still rigid and which further has a comparatively low tendency to oxidize. A material which is particularly suitable for this purpose is stainless steel. One end of the sheathing 12 is shaped as a sleeve 13, whereas the other end is shaped as a flat connecting tongue 14 with a bore 15 or any other opening to receive a pole screw or a similar current conducting member (not shown). The terminal 10 contains a filling 16 of pliable, good conducting material, preferably aluminum.

Figure 3:
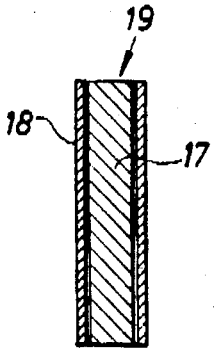
FIG. 3 is an axial longitudinal section of a blank for the manufacture of a terminal according to FIGS. 1 and 2.
Figure 4:
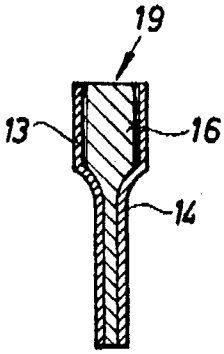
FIG. 4 illustrates, similarly in an axial longitudinal section, a first step of the manufacture of a terminal from a blank according to FIG. 3.

With reference to FIGS. 3 to 5 the manufacture of connecting terminals according to the present invention is carried out in such a manner that a thread 17, e.g. of alumina, having a jacket 18 of a suitable material, e.g. stainless steel, is first cut into blanks 19 of suitable length, such as is shown in FIG. 3. Then one end of the blanks 19 is compressed to form the flat connecting tongue 14. This tongue is then, by boring or punching, provided with an opening 15 to receive a conducting member. Of course the rod-shaped blank material may be provided with the flat connecting tongue 14 in advance of cutting off the blank from the rod-shaped blank material and if desired it is also possible to make the opening 15 in the same step.

As a last step the alumina filling in the uppermost portion of the terminal 10, is melted e.g. during direct passage of current therethrough after having been connected between two current conducting electrodes 20 and 21, such as is shown in FIG. 5, whereupon finally the end of the element 11 is dipped down into the aluminum melt and held fixed therein after the current is shut off until the melt has again solidified.

The terminal according to the invention is very sturdy and will therefore maintain the element thread in a securely fixed position. Further the terminal has a very great conductive area and big contact surfaces for which reason the current density will be rather low. Further the terminal has great radiation surfaces, which means that the contact temperature will be maintained low, despite the fact that the element temperature may normally be permitted to become rather high.

The terminal according to the invention has the special advantage that the portion of the element thread 11, which is normally subjected to the so called silicide pest and therefore is unnecessarily early deteriorated, is now shortened very much, or close to eliminated entirely.

This portion, which is otherwise normally subjected to the silicide pest, is the portion which is disposed between the red or even white glowing glow zone portion and the glow zone end which is considerably colder due to the heat conduction to the terminal.

It should be mentioned that the highly temperature resistant thread may have a diameter of from about 0.4 and up to about 2.0 mm, or slightly more. The aluminum thread 17, which forms the filling of the terminal, may have an original diameter of about 0.4 mm and up to about 6.0 mm or slightly more, depending on the application, and the stainless steel sheating may have an initial wall thickness of from 0.2 mm up to about 0.4 mm.

Modifications and alterations as to details may be carried out within the scope of the inventive idea.

I claim:

1. A terminal for an electrical heating resistance elements having a lead in electrode, wherein the heating resistance element comprises a thin thread of a highly temperature resistant material, which thread has, at at least one end thereof, a terminal of a material of a higher conductivity than that of the resistance thread and having a cross-sectional area which is considerably greater than that of the resistance thread, said terminal comprising an outer, comparatively thin-walled sheathing of an electrically good-conducting oxidation-resistant material, which permits forming by pressing but which is still rigid, said sheathing having the shape of a tube which at one end thereof merges with a flat-pressed tongue having a bore to receive a current conducting member, said sheathing containing a filling of a pliable, good-conducting material of lower melting point than said sheathing, in which filling the end of the element thread has a solidified melted connection.

2. A terminal according to claim 1, said thin-walled sheathing comprising stainless steel.

3. A terminal according to claim 5 wherein the sheathing is composed of stainless steel and the filling is composed of aluminum.

* * * * *